US006176190B1

(12) United States Patent
Ozga

(10) Patent No.: US 6,176,190 B1
(45) Date of Patent: Jan. 23, 2001

(54) SUSPENSION SYSTEM FOR A SPEED BOAT

(76) Inventor: John Ozga, 48560 Martz Rd., Belleville, MI (US) 48111

( * ) Notice: Under 35 U.S.C. 154(b), the term of this patent shall be extended for 0 days.

(21) Appl. No.: 09/351,188

(22) Filed: Jul. 12, 1999

(51) Int. Cl.[7] ..... B63B 1/00

(52) U.S. Cl. ..... 114/61.15; 114/272; 114/279; 114/283

(58) Field of Search ..... 114/271, 272, 114/273, 279, 283, 284, 292, 61.15, 191

(56) References Cited

U.S. PATENT DOCUMENTS

| | | | | |
|---|---|---|---|---|
| 2,617,377 | * | 11/1952 | Evans | 114/191 |
| 3,002,484 | | 10/1961 | Dube . | |
| 3,528,380 | | 9/1970 | Yost . | |
| 3,930,450 | | 1/1976 | Symons . | |
| 3,998,176 | | 12/1976 | Stout et al. . | |
| 4,228,752 | | 10/1980 | Sladek et al. . | |
| 4,351,262 | | 9/1982 | Matthews . | |
| 5,107,783 | | 4/1992 | Magazzu . | |
| 5,228,404 | | 7/1993 | Gibbs . | |
| 5,285,742 | | 2/1994 | Anderson . | |
| 5,348,265 | * | 9/1994 | Burg | 114/284 |
| 5,415,120 | | 5/1995 | Burg . | |
| 5,415,365 | * | 5/1995 | Ratliff | 114/272 |
| 5,465,678 | * | 11/1995 | Ekman | 114/284 |
| 5,474,011 | | 12/1995 | Steinberg . | |
| 5,570,650 | | 11/1996 | Harley . | |
| 5,603,281 | | 2/1997 | Harvey et al. . | |
| 5,647,296 | | 7/1997 | Pasanen . | |
| 5,697,317 | | 12/1997 | Pereira . | |
| 5,765,497 | | 6/1998 | Thomas et al. . | |
| 5,887,538 | | 3/1999 | Cruz . | |

* cited by examiner

*Primary Examiner*—Stephen Avila
(74) *Attorney, Agent, or Firm*—Harness, Dickey & Pierce P.L.C.

(57) ABSTRACT

A watercraft allowing relative motion of its deck relative to its hull structure to increase passenger comfort. The deck is mounted to the hull structure in a manner which permits relative motion of the deck structure to the hull in at least two independent axes.

23 Claims, 4 Drawing Sheets

SUSPENSION SYSTEM FOR A SPEED BOAT

FIELD OF THE INVENTION

This invention relates to a suspension system for a speed boat. More specifically, the invention is a suspension system in which the deck of the boat is allowed to move in a controlled manner in the pitch, yaw and roll axes to absorb shock and increase the comfort of the boat's passengers.

BACKGROUND OF THE INVENTION

Conventional boats are subject to wave action and, particularly for smaller boats or rougher water or faster boats, the resulting movements of the boat can be very uncomfortable for the passengers. In order to increase passenger comfort, some boats have incorporated suspension systems into the seating, or in the case of personal watercraft, the seating area. Other boats have used pontoon systems to control the entire boat's attitude and response to wave conditions.

One arrangement of a suspended seating area is shown in U.S. Pat. No. 5,603,281, issued Feb. 18, 1997. In the personal watercraft shown in that patent, various arrangements of suspension which act only in the primarily vertical plane are shown. The embodiments of the suspension shown in the patent are analogous to motorcycle suspensions since they only provide travel in the plane perpendicular to the underside of the watercraft. Thus, only the pitch motion of the watercraft is controlled. When the wave motion is oblique to the boat's direction of travel, the suspension cannot act to reduce components of acceleration and shock which are not in the plane in which the suspension system acts.

Since a boat must be capable of travelling in any direction relative to the waves, there are almost always pitch, roll and yaw components of motion dynamically induced by wave interaction. All of these components of motion cannot be reduced by a single plane suspension system primarily acting in the pitch axis.

Another attempt to improve occupant comfort in watercraft has been by using adjustable or dynamic pontoon arrangements on multi-hull watercraft. These arrangements are only applicable to multi-hull boats and require large, complicated hull assemblies which move relative to each other or to a main hull and attenuate the boat's dynamic response to wave action. Typically, the pontoons move primarily in the roll axis and can produce complex dynamic response to some wave conditions.

In view of the above and other limitations of the prior art, there exists a need for a watercraft ride enhancement system which attenuate more than just pitch motion.

Accordingly, an object of the present invention is to provide for dynamic control of the deck of a boat about the pitch, yaw and roll axes.

Another object of the present invention is to provide a dynamic control system or ride enhancement for the deck of a boat which is readily adaptable to a wide variety of hull designs, including single and multi-hull boat designs.

It is also an object of this invention to provide a dynamic control system which may have different spring and damping characteristics in the substantially pitch and substantially yaw axes.

An additional object of the present invention is to further enhance dynamic control of the boat's deck through use of the aerodynamic restorative force created by an airfoil.

SUMMARY OF THE INVENTION

In achieving the above objects and overcoming the drawbacks and limitations of the prior art, the present invention provides for the dynamic isolation of the deck, relative to the hull, to increase occupant comfort in a watercraft over a wide variety of water conditions, speeds, and directions relative to the waves. The deck is mounted to the hull structure in a manner which permits relative motion of the deck structure to the hull in at least two independent axes. Generally, at the bow end of the boat the deck is mounted to the hull structure through a multiaxes pivot mounting. At the stern end of the boat, the deck and hull structure are mounted together through a series of dampeners which are oriented to alternate pitch, yaw and roll motion. The suspension system provided for this purpose is extremely simple and rugged in structure and uses common, low cost components.

Still, further objects and advantages will become readily apparent to one skilled in this technology from a consideration of the ensuing description and drawings.

BRIEF DESCRIPTION OF THE DRAWINGS

Preferred embodiment of the invention is described in conjunction with the following drawings.

DESCRIPTION OF THE PREFERRED EMBODIMENTS

Figure 1:
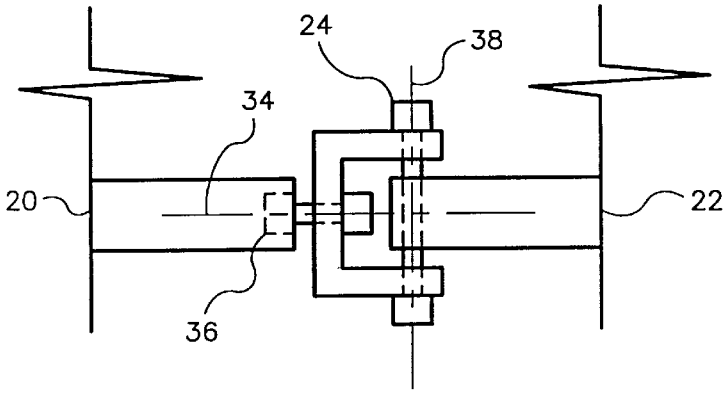
FIG. 1 is schematic view from the stern of a mono-hull boat incorporating the principles of the present invention.
Figure 2:
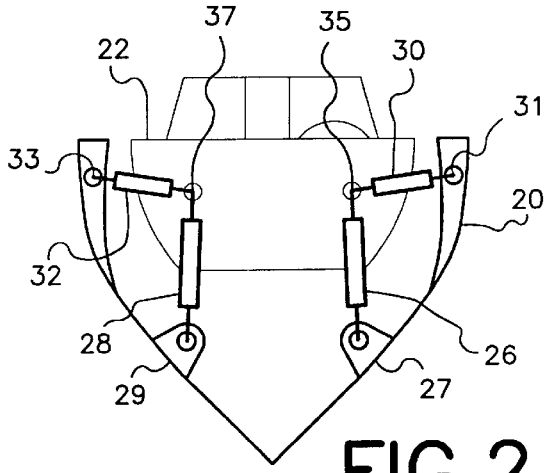
FIG. 2 is a bottom view of the boat seen in FIG. 1.

A watercraft or boat 10 according to the principles of the present invention has a hull 20 and a separate deck 22. The deck 22 contains the normal furnishings of a boat cockpit including steering means, a throttle and at the controls, operator seating and passenger seating. The bow of the hull 20 and the deck 22 are pivotally connected together by a pivot joint 24. As seen in FIGS. 1 and 2, the stern of the hull 20 and deck 22 are connected to one another by a left vertical shock assembly 28, a right vertical shock assembly 26, a right lateral shock assembly 30 and a left lateral shock absorber assembly 32. Where mounted to the hull 20, the shock absorber assemblies 26, 28, 30 and 32 are secured by mounting brackets 27, 29, 31 and 33. The mounting brackets 27, 29, 31 and 33 are of a variety suitable for the particular shock absorber assemblies 26, 28, 30 and 32 being used. Similarly, where secured to the deck 22, mounting brackets 35 and 37 of suitable style are used. As seen in FIGS. 1 and 2, in the first embodiment of the present invention the right side shock absorber assemblies 26 and 30 are mounted to the stern wall 21 at a common point, mounting bracket 35. The left side shock absorbers assemblies 28 and 32 are likewise mounted to the stern wall 21 at a common point, mounting bracket 37.

While use of common mounting points is believed to offer ride enhancement benefits, it will be appreciated that individual mounting brackets on the stern for each shock absorber assembly could be employed. Also, while the shock absorber assemblies are illustrated and referred to as either vertical or horizontal, these terms are not intended to be strictly interpreted as the orientation of their respective assemblies. The assemblies 26, 28, 30 and 32 can be provided in other orientations so long as vertical and horizontal components of movement will be attenuated by the overall system. Depending on the boat 10 design and the water conditions in which the boat 10 is intended to be operated, other orientations may prove to be more desirable.

Figure 3:
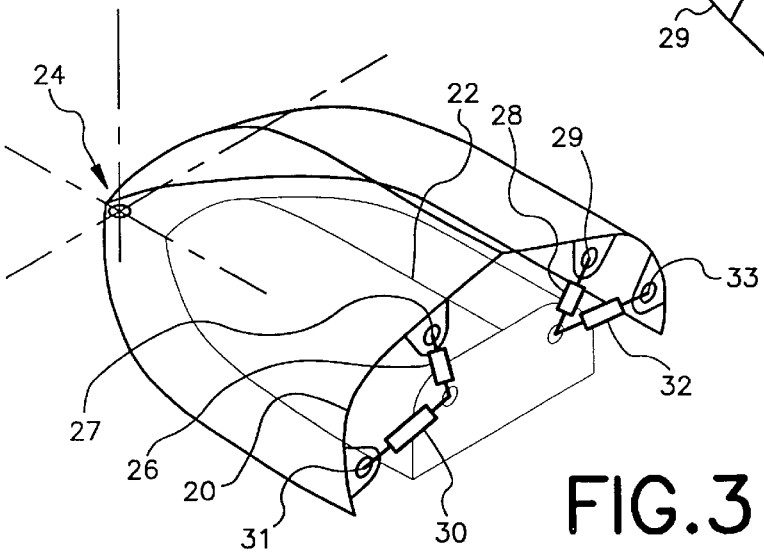
FIG. 3 is a side schematic view of the pivot joint located at the bow of the boat.

The mounting brackets 35 and 37 themselves may also be positioned other than on the stern wall 21. For example, the brackets 35 and 37 may be positioned on the corner where the stern wall 21 meets the side walls or gunwalls of the boat 10. Through use of the pivot joint 24 and the various shock assemblies 26, 28, 30 and 32, movement about a roll axis pivot 34, a pitch axis pivot 36 and a yaw axis pivot 38 (as seen in FIG. 3) can be controlled.

In operation the deck 22 of the boat 10 is free to pivot about pivot joint 24 and move within the hull 20 as controlled by shock absorber assemblies 26, 28, 30 and 32. Relative motion between the deck 22 and hull 20 is allowed in the pitch, yaw and roll axes to account for all possible wave induced motion. Based on the desired dynamic response characteristics of the boat 10, the lateral shock absorber assemblies 30 and 32 may have different spring and damping characteristics than the vertical shock absorber assemblies 26 and 28.

Figure 4:
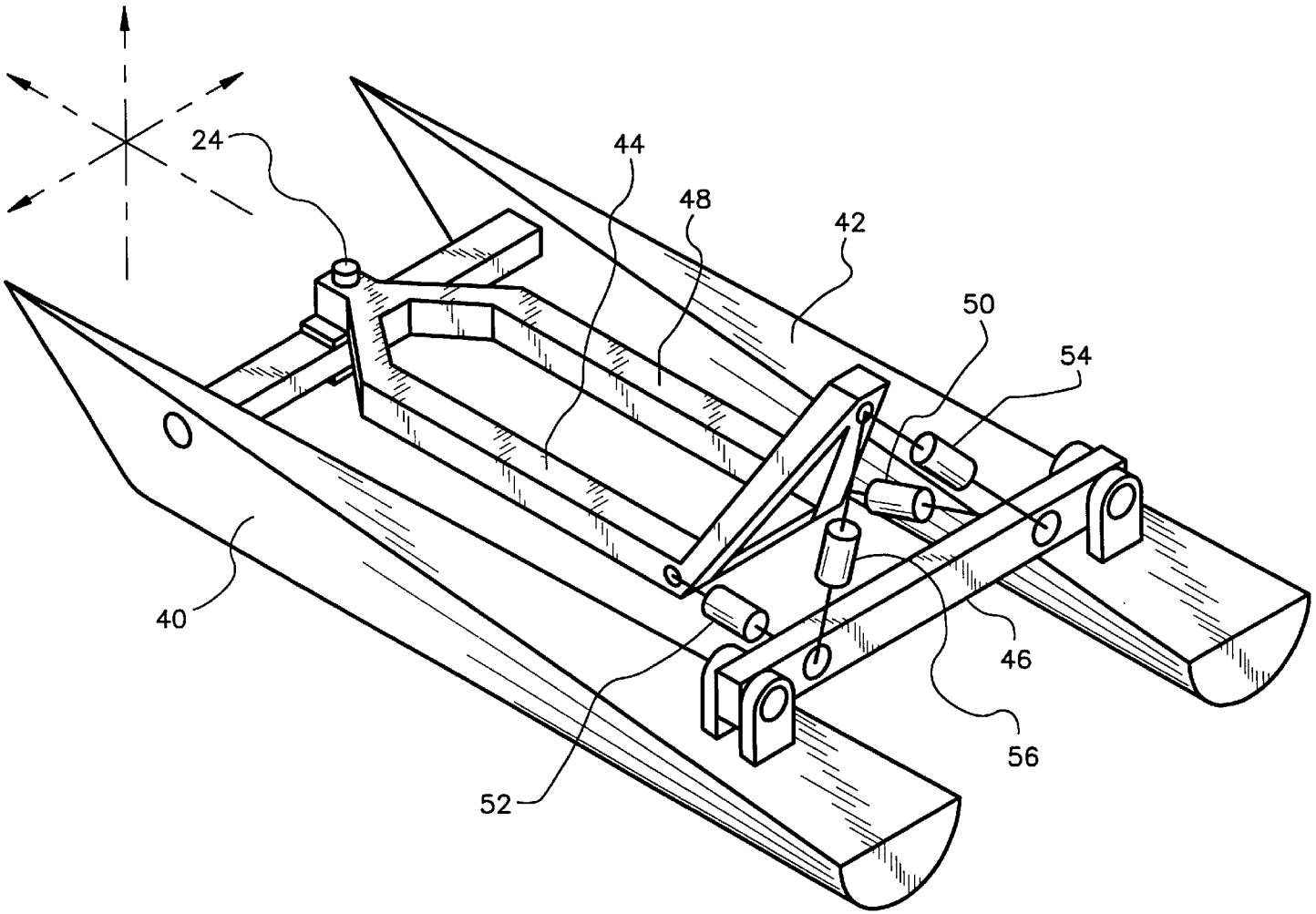
FIG. 4 is a schematic perspective view of the present invention as applied to a multi-hulled boat, more specifically a catamaran.
Figure 5:
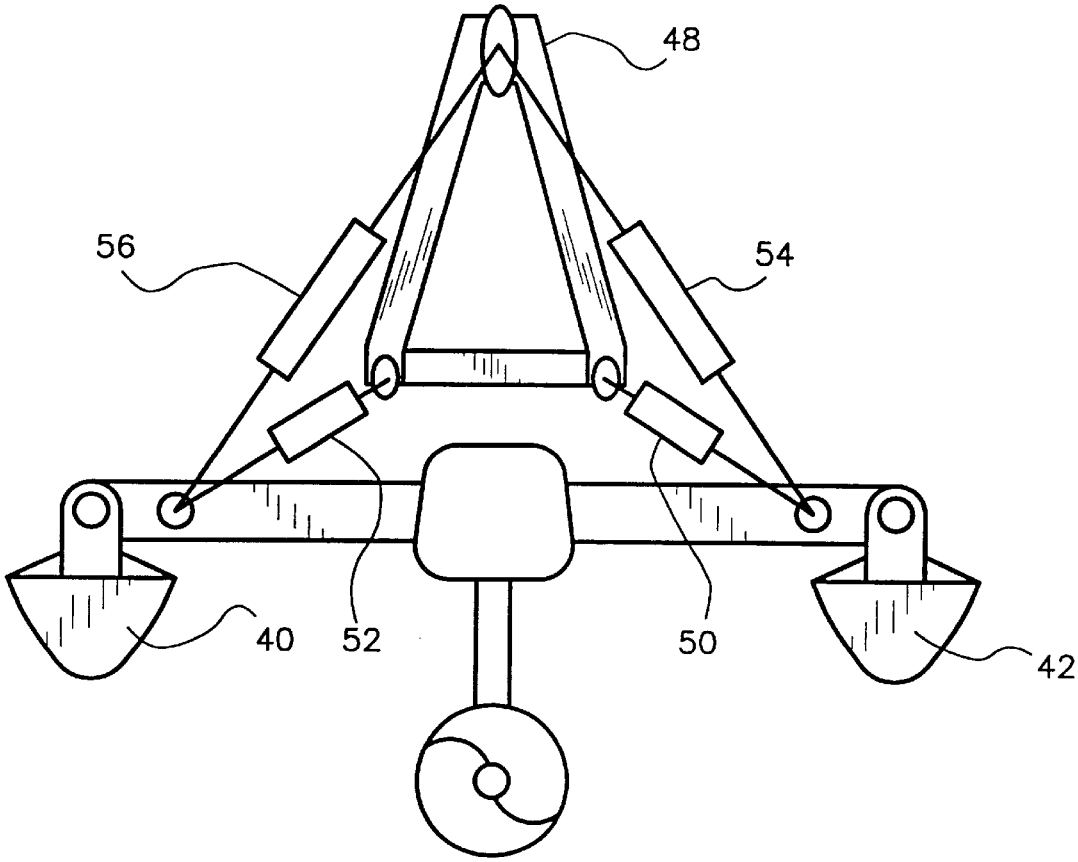
FIG. 5 is a rear view of the embodiment shown in FIG. 4.

In FIGS. 4 and 5, another embodiment of the invention is shown. The deck (not shown) is supported by a deck frame 48 mounted to a catamaran watercraft with left hull 40, right hull 42, forward transverse member 44 and rear transverse member 46 forming a rigid multi-hulled structure. The deck frame 48 pivots about pivot joint 24, which has the same configuration as shown in FIG. 3 and the rear portion of the deck frame 48 is movably connected to the rear transverse member 46 by right lower shock absorber assembly 50, left lower shock absorber assembly 52, right upper shock absorber assembly 54, and left upper shock absorber assembly 56. In this embodiment, each pair of left and right side shock absorbers, 56, 52, and 54 and 50 are not located on approximately orthogonal axes as in the prior embodiment. Movement of the deck relative to the hull structure is still allowed in the pitch, yaw and roll axes.

Figure 6:
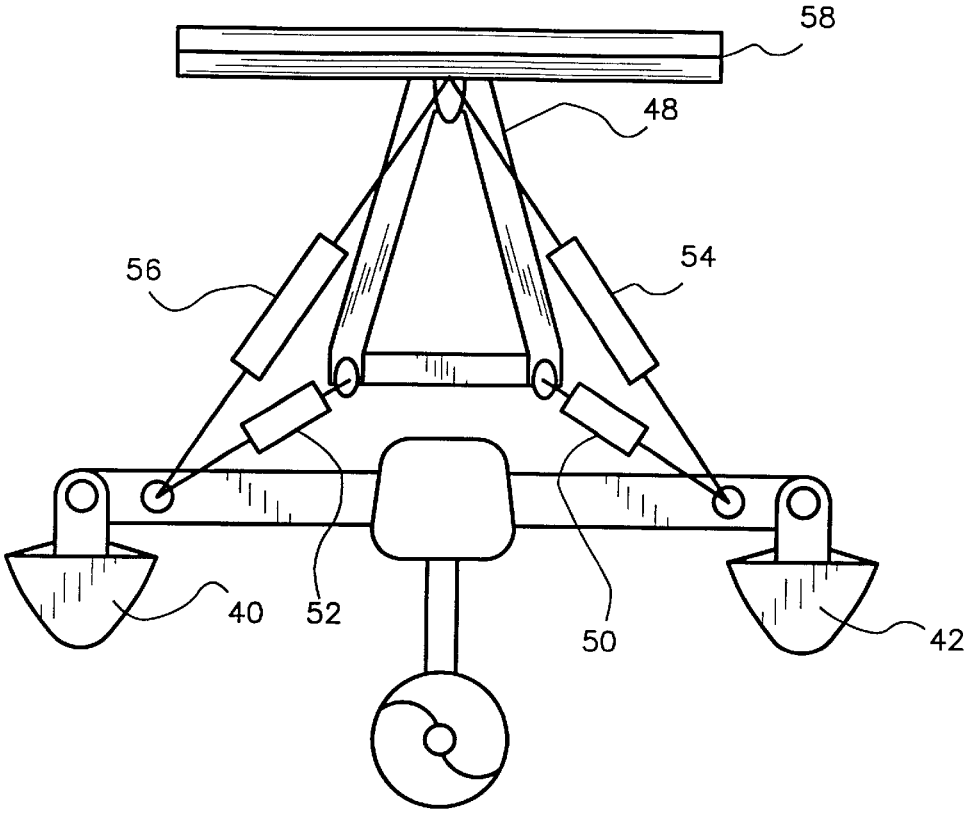
FIG. 6 shows an airfoil added to the embodiment shown in FIG. 5.
Figure 7:
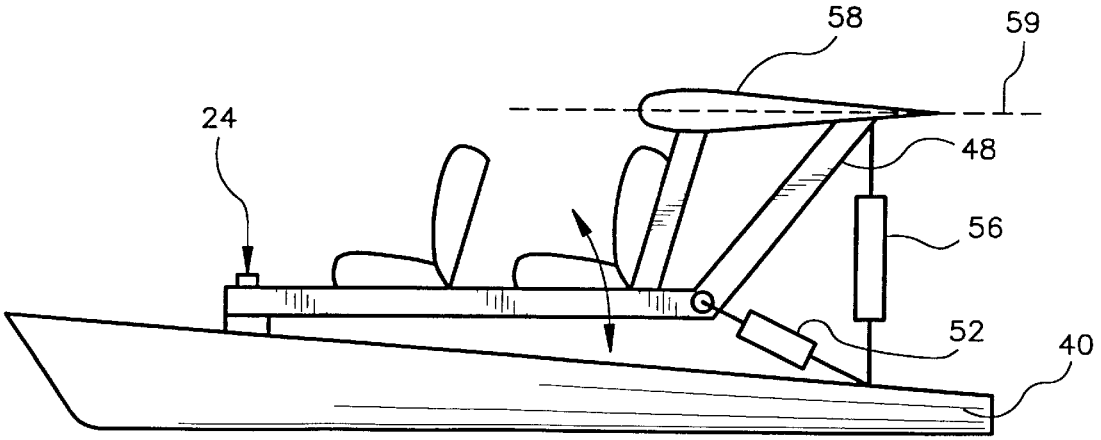
FIG. 7 is a side view of the embodiment shown in FIG. 6.
Figure 3:
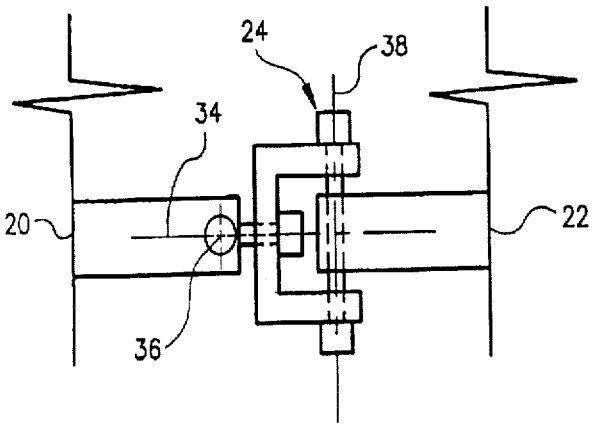
Figure 1:
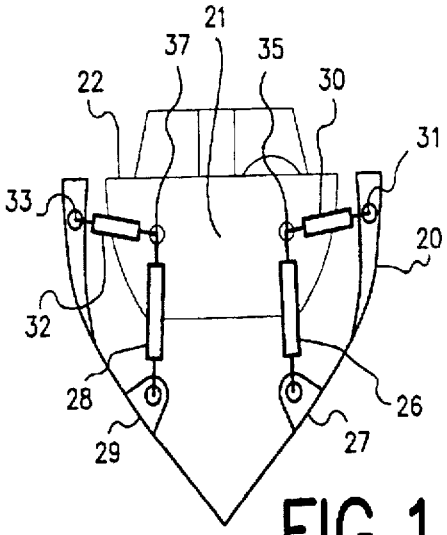
Figure 2:
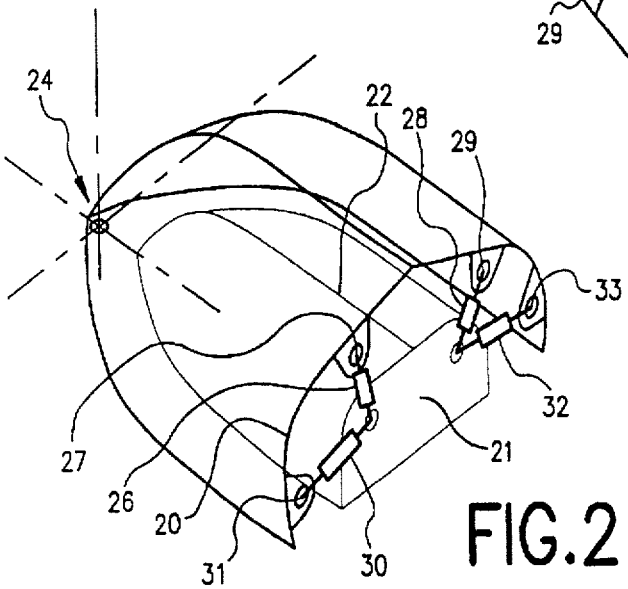
Figure 4:
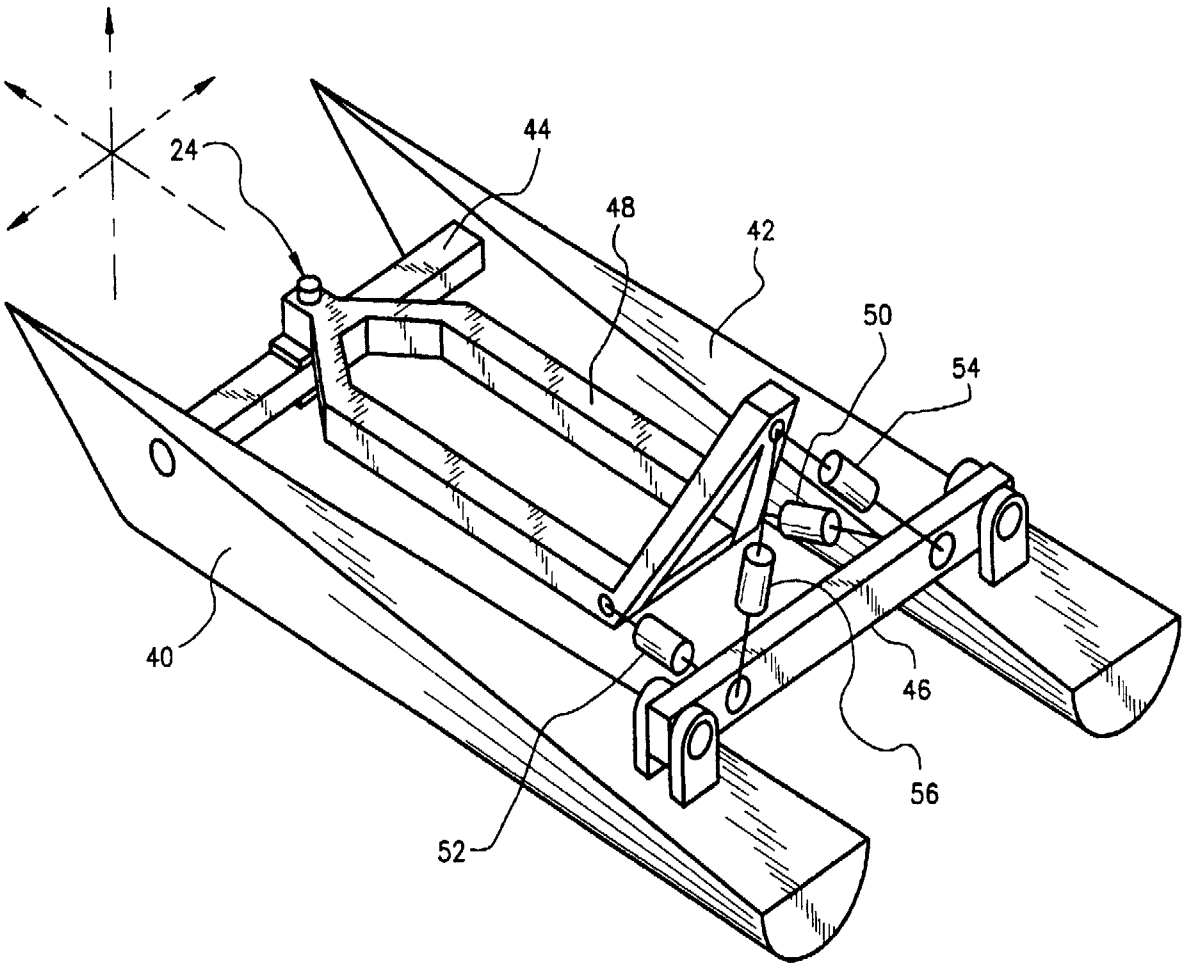

In FIGS. 6 and 7, an airfoil 58 is rigidly mounted to the top of the deck frame 48 so as to be positioned above and generally aft of the occupant compartment or cockpit of the boat 10. As seen in FIG. 7, the airfoil 58 is symmetrical about its chordal axis 59. When the watercraft 10 is moving forward, the aerodynamic effect of the airfoil applies a restorative force to the deck frame 48 to pivot it to a neutral position about the pitch axis. For example, when the fore end of deck frame 48 and deck are caused to be pitched upward relative to the aft end of the boat 10, the airfoil 58 is provided with an angle of attack relative to the airflow which applies an upward force to the airfoil 58 and to the deck frame 48. Likewise, when the aft end of the deck frame 48 pivots upward, a downward force is generated on the airfoil 58. Thus, the effect of the airfoil 10 is to provide additional restorative force to the deck frame 48 when the watercraft 10 travels at higher speeds or is pitched severely.

Accordingly, the reader will see that the watercraft of the present invention provides a deck suspension system, controlling acceleration and shock, which enhances the ride comfort of the users. Furthermore, the watercraft with deck suspension system has the additional advantages in that:

It is adaptable to many configurations of watercraft;

It uses readily available suspension components from other types of vehicles;

It is further adaptable to active control systems such as hydraulics or electric cylinders;

It is further adaptable to servo control.

Although the description above contains many specificities, these should not be construed as limiting the scope of the invention by merely providing illustrations of some of the presently preferred embodiments of this invention. For example, the suspension could use fewer or more shock absorber assembly units. The shock absorber assembly units could be user adjustable to tune the system to the wave conditions, etc.

Thus, the scope of the invention should be determined by the appended claims and their legal equivalence, rather than by the examples given.

What is claimed is:

1. A watercraft comprising:

a deck having a bow end and a stern end;

a hull structure including at least one hull, said hull structure having a bow end and a stern end; and mounting means for mounting said deck to said hull structure and for permitting movement of said deck relative to said hull structure about at least two independent axes, said mounting means includes a pivot joint mounting said bow end of said deck to said bow end of said hull structure, said pivot joint permits movement of said deck relative to said hull structure about pitch, yaw and roll axes.

2. The watercraft recited in claim 1 wherein said mounting means includes at least two dampeners mounting said stern end of said deck to said stern end of said hull structure.

3. The watercraft recited in claim 2 wherein said dampeners are spring mass dampeners.

4. The watercraft recited in claim 2 wherein said dampening means are hydraulic dampening shock absorbers.

5. The watercraft recited in claim 2 wherein said dampening means are pneumatic dampening shock absorbers.

6. The watercraft recited in claim 2 wherein at least one of said dampeners is oriented at an orientation other than vertical relative to said hull structure.

7. The watercraft recited in claim 2 having four dampeners.

8. The watercraft recited in claim 7 wherein two of said dampeners are positioned on each lateral side of said watercraft.

9. The watercraft recited in claim 8 wherein one of said two dampeners on each lateral side is oriented at an orientation other than generally horizontally relative to said hull structure.

10. The watercraft recited in claim 1 wherein said mounting means attenuates movement of said hull structure relative to said deck.

11. The watercraft recited in claim 1 wherein said hull structure is a mono-hull.

12. The watercraft recited in claim 1 wherein said hull structure is a catamaran.

13. The watercraft recited in claim 12 wherein said hull structure is generally rigid.

14. The watercraft in claim 1 wherein said hull structure is a trimaran.

15. The watercraft recited in claim 14 wherein said hull structure is generally rigid.

16. The watercraft recited in claim 1 further comprising an airfoil mounted to said deck.

17. The watercraft recited in claim 16 wherein said airfoil is symmetrical about a chordal axis.

18. The watercraft recited in claim 16 wherein said airfoil is mounted aft of said passenger compartment.

19. The watercraft recited in claim 16 wherein said airfoil is rigidly mounted to said deck.

20. A watercraft comprising:

a deck having a bow end and a stern end;

a hull structure including at least one hull, said hull structure having a bow end and a stern end; and mounting means for mounting said deck to said hull structure and for permitting movement of said deck relative to said hull structure about at least two independent axes, said mounting means includes a pivot joint mounting said bow end of said deck to said bow end of said hull structure, said pivot point permits movement of said deck relative to said hull structure about pitch, yaw and roll axes, said pivot joint is a universal joint which permits movement of said stern end about said bow end.

21. A watercraft comprising:

a deck having a bow end and a stern end;

a hull structure including at least one hull, said hull structure having a bow end and a stern end; and mounting means for mounting said deck to said hull structure and for permitting movement of said deck relative to said hull structure about at least two independent axes, said mounting means includes four dampeners mounted to said stem end of said deck to said stem end of said hull structure, said two of said dampeners are positioned on each lateral said of said watercraft and are mounted to said stern end of said deck at a common mounting bracket located thereon.

22. A watercraft comprising:

a deck having a bow end and a stern end;

a hull structure including at least one hull, said hull structure having a bow end and a stern end; and mounting means for mounting said deck to said hull structure and for permitting movement of said deck relative to said hull structure about at least two independent axes, said mounting means includes four dampeners mounted to said stem end of said deck to said stem end of said hull structure, said two of said dampeners are positioned on each lateral said of said watercraft and are mounted and one of said two dampeners on each lateral side is oriented generally horizontally relative to said hull structure.

23. A watercraft comprising:

a deck having a bow end and a stern end;

a hull structure having a bow end and a stern end, said hull structure including at least one hull and said deck being located within said hull structure;

a plurality of movement attenuators mounted between said hull structure and said deck and supporting said deck for relative movement with respect to said hull structure about at least two independent axes;

an at least three axis pivot mounting, said pivot mounting supporting said deck at said bow end relative to said hull structure.

* * * * *

UNITED STATES PATENT AND TRADEMARK OFFICE

CERTIFICATE OF CORRECTION

PATENT NO. : 6,176,190 B1
DATED : January 23, 2001
INVENTOR(S) : John Ozga

It is certified that error appears in the above-identified patent and that said Letters Patent is hereby corrected as shown below:

Delete drawing sheets 1 and 2 showing Figures 1 through 4, and substitute therefor the drawing sheets, comprising Figures 1 through 4, as shown on the attached pages.

Signed and Sealed this

Twenty-third Day of October, 2001

*Attest:*

Nicholas P. Godici

NICHOLAS P. GODICI

*Attesting Officer*

*Acting Director of the United States Patent and Trademark Office*